United States Patent [19]

Aldrich et al.

[11] Patent Number: 5,012,289

[45] Date of Patent: Apr. 30, 1991

[54] TONER METERING APPARATUS

[75] Inventors: Charles S. Aldrich; Steven L. Applegate; James A. Craft; James J. Molloy, all of Lexington; Michael L. Pawley, Nicholasville, all of Ky.

[73] Assignee: International Business Machines Corporation, Armonk, N.Y.

[21] Appl. No.: 392,680

[22] Filed: Aug. 11, 1989

[51] Int. Cl.[5] ..... G03G 00/00

[52] U.S. Cl. ..... 355/260; 118/656; 118/661; 222/DIG. 1; 355/259

[58] Field of Search ..... 355/259, 260, 298, 245; 222/DIG. 1; 118/661, 656

[56] References Cited

U.S. PATENT DOCUMENTS

| | | | |
|---|---|---|---|
| 3,550,555 | 12/1970 | Hudson | 222/DIG. 1 X |
| 4,660,960 | 4/1987 | Fukunaga et al. | 355/260 |
| 4,797,704 | 1/1989 | Williams et al. | 355/260 |

*Primary Examiner*—A. T. Grimley
*Assistant Examiner*—Thu A. Dang
*Attorney, Agent, or Firm*—John W. Girvin, Jr.

[57] ABSTRACT

A developer apparatus (29) for use in an electrostatic reproduction apparatus includes a large reservoir of toner (34, 44). The toner is located in a supply chamber (39) and is metered to a developer roller chamber (35) from which it is carried by a developer roller (31) past a doctor blade (36) to a photoconductor drum (19) for image development. A toner metering roller (41) rotates with the developer roller (31) to provide a continuous supply of toner from the supply chamber (39) to the developer chamber (35). Once an equilibrium level (65) is reached, the toner metering roller (41) acts to remove toner (34) from the developer chamber (35) to the supply chamber (39) to insure proper operation of the developer roller (31).

12 Claims, 6 Drawing Sheets

TONER METERING APPARATUS

BACKGROUND OF THE INVENTION

1. Technical Field

This invention relates to a toner metering apparatus for an electrostatic reproduction apparatus and more particularly, to a toner metering apparatus for use in conjunction with a developer roll developer apparatus.

2. Background Art

In well known electrostatic printing processes, including electrophotographic or xerographic reproduction processes, an electrostatic latent image is formed on a moving charge retaining surface such as a photoconductor that repeatedly cycles through the reproduction process as the photoconductor is reused.

In the electrophotographic process, the first process step can be considered to be the full surface charging of the photoconductor to a uniform and usually quite high DC voltage, as the photoconductor moves past a charging station such as a charge corona. The charged photoconductor surface is then moved through an imaging station.

In a copier, the imaging station usually comprises an optical system that operates to reflect light off of an original document to be copied. As a result of the reflected light received from the document's white or lightly colored background area, the photoconductor retains a charge only in the area that corresponds to the document's darker or less reflective image area. This latent image is then toned, that is, covered with toner particles, as the photoconductor passes through a developing station. Since toner is applied to the charged latent image in a copier, the process is called a charged area development (CAD) process.

In a printer, the imaging station usually comprises a printhead that is driven by binary print data that is supplied by a computer. Laser printheads and LED printheads are two such well known imaging stations. Printers usually operate to discharge the photoconductor in the pattern of the image to be printed, that is, the printhead usually writes the image to be printed, and as a result the latent image comprises discharge areas of the photoconductor. However, printers can also be configured to write the background, in which case the latent image comprises a charged photoconductor area. In any event, this latent image is then toned, that is, covered with toner, as the photoconductor passes through a developing station. When toner is applied to the discharged latent image in a printer, the process is called a discharged area development (DAD) process. When toner is applied to the charged latent image in a printer, the process is again called a CAD process.

An additional electrostatic printing process employs a stationary array of charging elements which are selectively energized to form a charge pattern or image on a moving charge retaining surface. This surface is then toned as the surface passes through a developing station.

As will be apparent, the present invention relating to the development of a toned image on a charged surface finds utility in either a printer or a copier, and in either a CAD or DAD process. An embodiment of the invention to be described is that of a DAD printer.

The usual next step of either a copier or printer process is to transfer the toner image that is carried by the charged surface down-stream of the developer station to a transfer material such as paper. This is accomplished when the paper is supplied to a transfer station where it moves in actual contact or close proximity to the moving toned surface. As one side of the paper is in this close proximity of the toned surface, the other side of the paper is subjected to the action of a toner transfer station. Two well known transfer stations are roll transfer and corona transfer. In either event, an electrical charge is applied to the side of the paper removed from the toned surface so as to attract toner from the toned surface to the side of the paper in contact or proximity therewith.

Thereafter, the paper is separated from the moving surface and is transported to a fusing station whereat the toner is fused to the paper. The moving surface is then usually discharged and cleaned of residual toner in preparation for reuse in the reproduction or printing process.

Various development processes have been used for applying toner to the moving charged surface. One such technique employs a developer roller which is covered with toner in a manner to electrostatically charge the toner, rotated past a doctor blade to form a thin layer of charged toner on the developer roller and then rotated into contact or close proximity to the moving charged surface. The developer roller is electrically biased in a manner to form an electrical field so that the charged toner located on the surface of the developer roller adheres to the image pattern to be developed and is repelled from that area of the image pattern not to be developed.

Toner is supplied to prior art developer rollers by various processes. In one process, toner is added in bulk quantities to a sump in which the developer roller rotates from the sump area past the doctor blade to the photoconductor. The level of toner in the sump never exceeds a predetermined maximum level due to operator control of the level. When utilizing this developer system, toner particles having the smallest particle size tend to be utilized first leaving a toner mix of relatively large particle sizes. Thus, quality of the output copy deteriorates as toner is exhausted from the sump. Upon toner exhaustion, a new package of toner is added to the sump by the operator. A further problem with a sump system occurs when printing large black areas in one zone of the photoconductor. As toner is exhausted from the corresponding zone of the sump, light or uneven printing occurs in that zone.

A further aspect of the prior art involves the resupply of toner to a copier or printing machine to replace the toner exhausted in making copies. Typical prior art machines employed a mixture of toner and reusable carrier particles in the developing station. Various means were utilized to maintain a proper ratio of toner to carrier. Usually, the mixture was sampled and toner automatically added when required from a toner supply container. When toner was exhausted from the container, it was replaced with a new container of toner.

More recent prior art systems have utilized a cartridge which includes charging device(s), a developer system with a large supply of toner, the photoconductor, and a cleaning system for the photoconductor, all of which are discarded as a unit when the toner is exhausted. Such cartridge systems require a large supply of toner in order that the cartridge can be utilized to make a sufficient number of prints, hence making such cartridge systems economically feasible.

When such a large supply of toner is utilized with a developer roller system, large quantities of toner tend to accumulate in proximity to the doctor blade causing excess toner to be forced through to the photoconductor. This in turn causes more toner to adhere to image areas and possibly to non-image areas and consumes excess toner. Further, the pressure created at the doctor-blade developer roller interface due to large pile ups of toner causes the trapping of large toner particles at the interface and subsequent lack of toner in sections of the developer roller thus causing streaking on the print.

SUMMARY

In order to overcome the above noted shortcomings of the prior art and to provide a developer roller system which incorporates a large supply of toner without creating a risk of toner pile up at the developer roller-doctor blade interface and without necessitating a form of automatic toner level sensing, the present invention incorporates a toner metering device located between a large toner supply chamber and the developer roller chamber to both supply toner to the developer roller chamber and to remove it therefrom back to the supply chamber when the toner level exceeds an equilibrium level. The toner metering device is arranged so that more toner can be removed from the developer chamber than is supplied thereto thereby insuring that the equilibrium level can be maintained. A common gear drive is utilized for the metering device and the developer roller so that no special automatic control is required to maintain the proper supply of toner in the developer roller chamber. A passageway connects the supply chamber to the developer roller chamber to maintain even air pressure distribution within the overall cartridge thereby reducing toner leakage. By continuously supplying a fresh supply of toner, consistent development throughout the life of the toner supply is maintained. Further, by removing excess toner from the developer roller chamber, excess toner consumption is eliminated, uniform toner height is maintained along the length of the developer roller and good printing results.

Accordingly, it is the principal object of the invention to automatically and precisely control the level of toner in the vicinity of a developer roller by effecting both the addition and removal of the toner from the chamber containing the developer roller. A further object of the invention is to maintain consistency in the image quality of an electrostatic printing device utilizing a developer roller. Such consistency is obtained by maintaining a proper ratio of small toner particles and large toner particles in a toner mix.

The foregoing objects, features and advantages of the invention will be apparent from the following more particular description of the preferred embodiment of the invention as illustrated in the accompanying drawings.

IN THE DRAWINGS

DESCRIPTION

Figure 1:
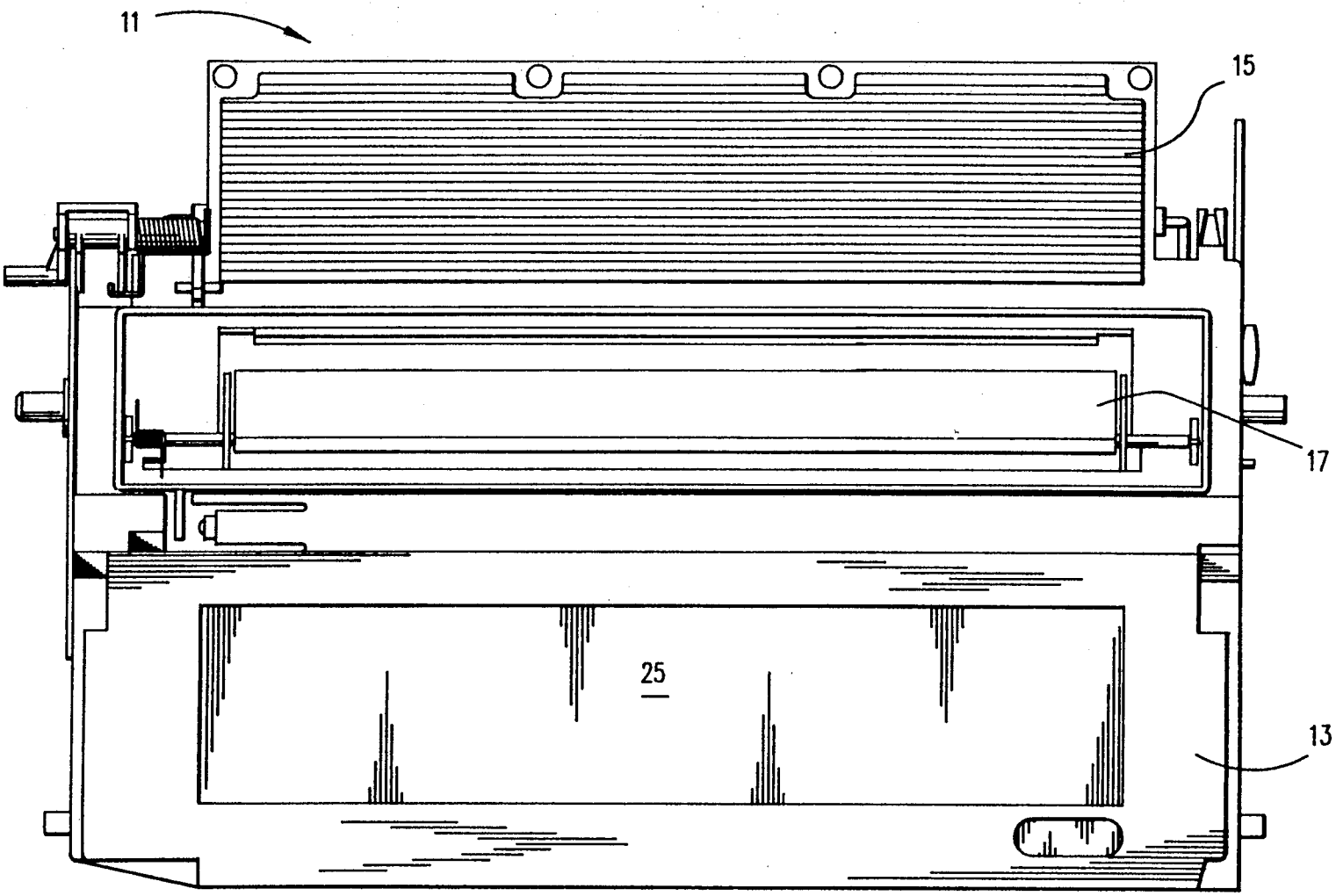
FIG. 1 is a top view of a replaceable cartridge which includes the developer apparatus of the present invention.
Figure 2:
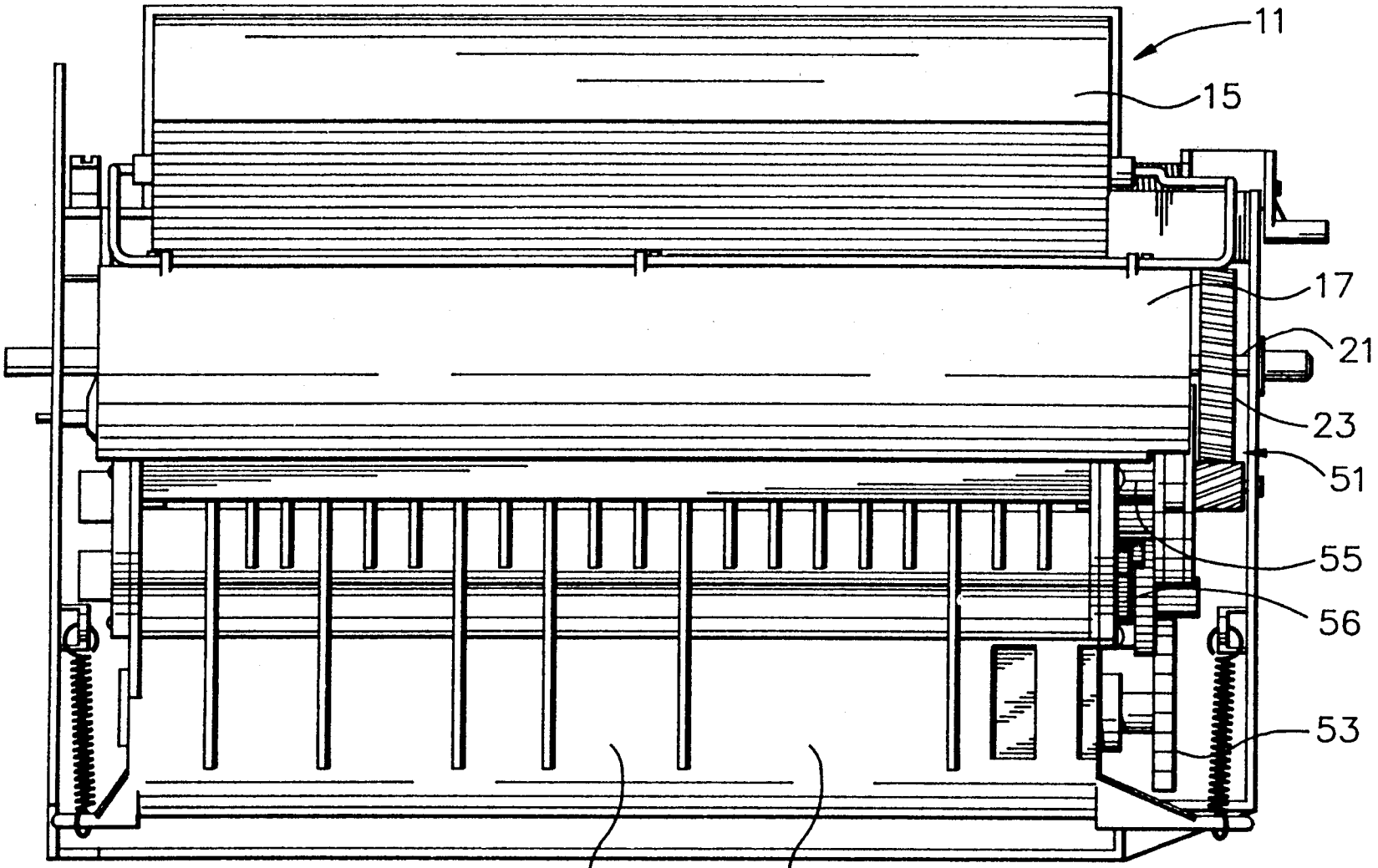
FIG. 2 is a bottom view of the replaceable cartridge of FIG. 1.
Figure 3:
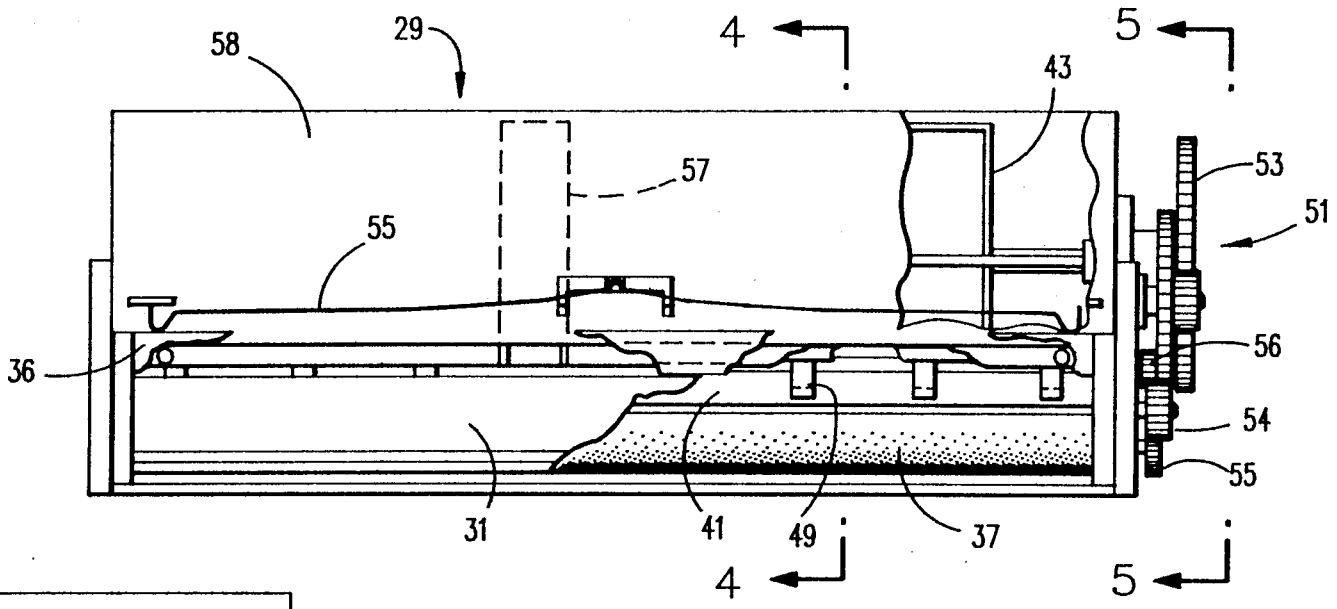
FIG. 3 is a side view, partially broken, of the developer apparatus of the present invention.

Referring now to FIGS. 1 and 2 of the drawing, there is depicted a top and bottom view respectively of a replaceable cartridge 11 suitable for use with an electrophotographic printing device. The cartridge includes a development zone 13, a cleaning zone 15 and a photoconductor zone 17. The photoconductor is located on a drum 19 (FIG. 4) which turns on shaft 21 and with gear 23. The drum 19 thus rotates past the conventional electrophotographic printing stations previously described. The developing station located within the development zone 13 includes a large supply of toner as will be described, thus accounting for its large volume. The cleaning station located within the cleaning zone 15 removes unused toner from the drum 19 and stores it until the cartridge 11 is replaced. The developer apparatus of FIG. 3 is located under the top surface 25 of the cartridge 11 within the development zone 13. The bottom surface 27 of the cartridge 11 forms a portion of the developer roller chamber as will be described.

Figure 5:
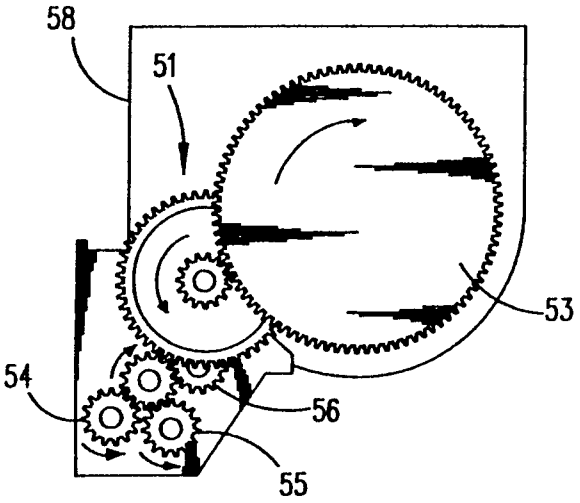
FIG. 5 is an end view of the developer apparatus of the present invention.
Figure 4:
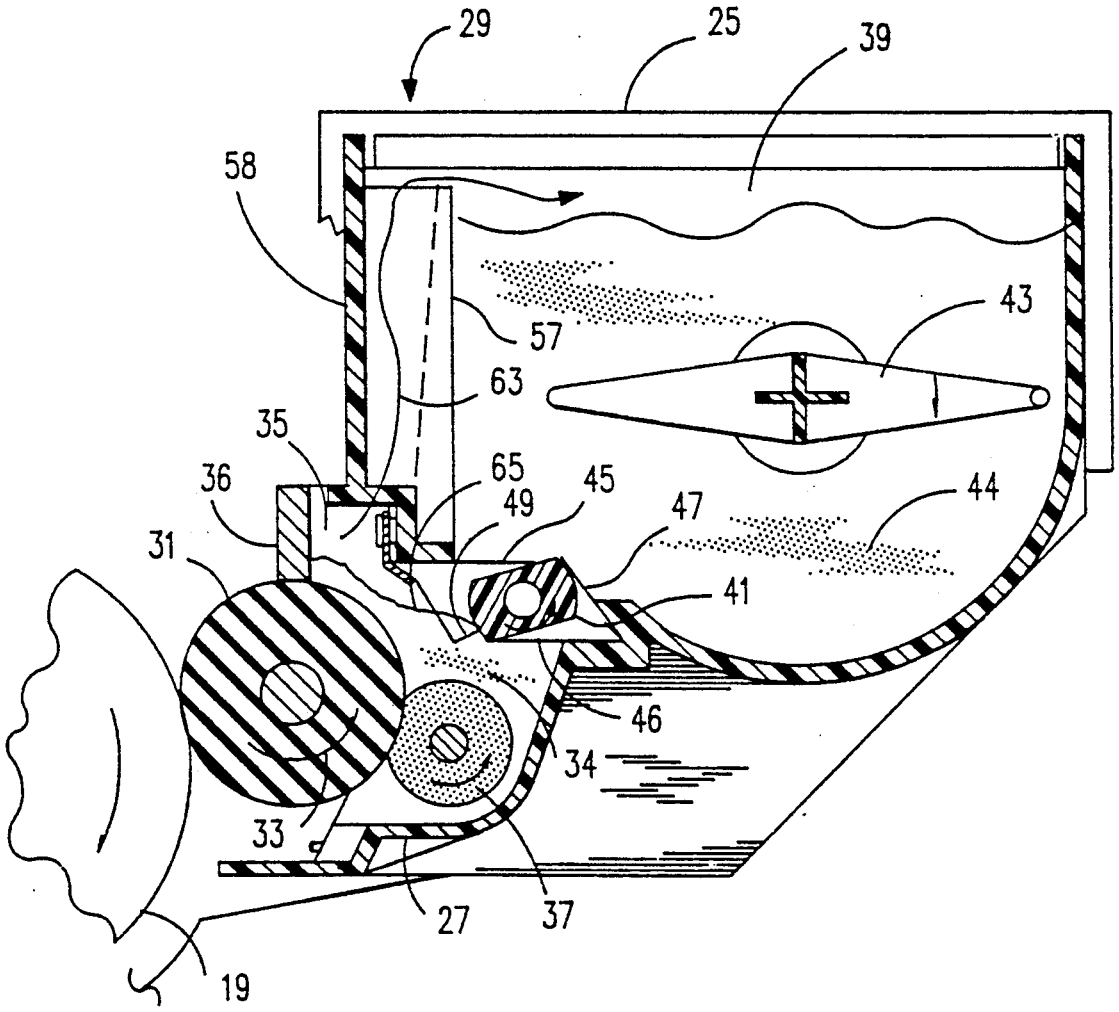
FIG. 4 is a section view along line 4—4 of FIG. 3 of the developer apparatus.

The following description refers to FIGS. 3-5 which depict the developer apparatus 29 which is located within the development zone 13 of the cartridge 11. The developer apparatus 29 includes a developer roller 31 which rotates in the direction of arrow 33 to carry toner 34 from the developer roller chamber 35 past the doctor blade 36 into contact with the photoconductor drum 19. The toner adder roller 37 rotates in the same direction as the developer roller 31. The toner adder roller is a highly porous roller made of carbon loaded polyether urethane foam and is compressed as it rotates into contact with the developer roller. The toner adder roller 37 creates a frictional charging action to electrostatically charge the toner 34 as it rotates. The developer roller comprises a conductive metal shaft surrounded by a rubber roll with an outer surface of a thin coating of urethane. The rubber roll is a nitryl rubber. The toner 34 comprises a blend of styrene-acrylic resin, wax, carbon black silicon carbide, aerosil and a charge control agent. The toner has a nominal particle size of 11 microns, with no more than 2.5% by weight less than 5 microns and no more than from 6% to 12% by weight greater than 16 microns.

A bias of approximately negative 645 volts is applied to the toner adder roller 37 and to the doctor blade 36 and a bias of approximately negative 525 volts is applied to the developer roller 31. The photoconductor drum 19 is charged to a negative 900 volts and the discharged image area is approximately negative 150 volts. The toner 34 is electrostatically charged negatively so that it preferentially adheres to the developer roller 31 until it contacts the surface of the photoconductor drum 19. At this time, the toner is attracted to the image areas on the photoconductor drum and repelled from the undischarged or background areas. This is a discharge area development (DAD) system as previously described.

Toner is supplied to the developer roller chamber 35 from a supply chamber 39 through the action of a toner metering roller 41. During operation, a paddle device 43 constantly rotates within the supply chamber 39 to insure that toner 44 does not agglomerate and is in the vicinity of the toner metering roller 41. The toner metering roller 41 cooperates with three flaps 45, 46 and 47 to meter the toner 44 from the supply chamber 39 to the developer roller chamber 35 and to effect removal of excess toner 34 from the developer roller chamber 35 back to the supply chamber 39. Scraper fingers 49 act to clean the surface of the toner metering roller 41 to insure that the toner is dislodged therefrom. The flaps 45, 46 and 47 and the fingers 49 are made of a thin flexible plastic material such as Mylar polyester.

The paddle 43, toner metering roller 41, toner adder roller 37, developer roller 31 and photoconductor drum 19 are driven from a common drive source, their drives being interconnected to one another through gearing 51. Gear 53 drives the paddle 43, gear 54 drives developer roller 31, gear 55 drives toner adder roller 37 and gear 56 drives toner metering roller 41, and gear 23 (FIG. 2) drives drum 19.

The doctor blade 36 is biased against the developer roller 31 by leaf spring 55. The force of the doctor blade 36 against the developer roller 31 is nominally 8 Newtons. The doctor blade roughness is nominally 1.3 microns Ra at 5.6 mm tracing length. The developer roller 31 roughness is nominally 0.48 microns Ra at 0.56 mm tracing length. These conditions result in a nominal flow rate of toner under the doctor blade 36 of 0.6 milligrams per square centimeter of developer roller surface. Metering roller 41 transfers toner from the supply chamber 39 to the developer roller chamber 35 at a nominal rate of 150 milligrams/second.

Figure 7:
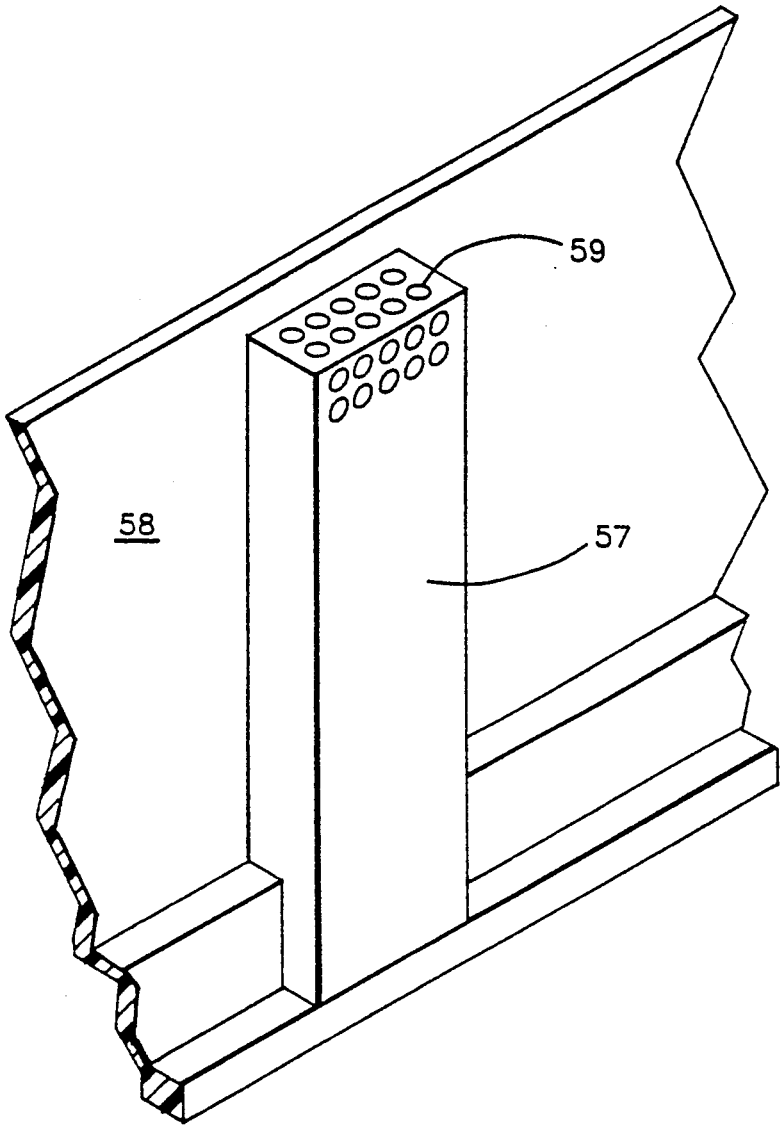
FIG. 7 is an illustration of the passageway within the developer apparatus.

The developer apparatus 29 is sealed so that toner 44 and toner 34 remain within the developer apparatus 29 until consumed by the action of developer roller 31 carrying the toner 34 to the drum 19. Unused toner on the developer roller 31 is returned to the developer roller chamber 35 upon continued rotation of the developer roller. A passageway 57 located on the front wall 58 connects the developer roller chamber 35 with the supply chamber 39. Perforation vents 59 (FIG. 7) allow air to flow between the chambers as indicated by arrow 63 (FIG. 4) to equalize pressure therebetween while preventing toner from immigrating from the supply chamber to the developer chamber through this passageway 57. The pumping action of the toner metering roller 41 would otherwise create pressure impulses within chambers 35 and 39 thus tending to undesirably force toner out of the seals of the developer apparatus 29 into the printing machine.

As has been described, the toner metering roller 41 maintains the toner 34 in the developer roller chamber 35 at an equilibrium level 65. This is accomplished by both supplying toner 44 from the supply chamber 39 to the developer roller chamber 35 and by removing excessive toner 34 from the developer roller chamber 35 to the supply chamber 39. The equilibrium level 65 of the toner 34 depicted in FIG. 4 shows an amount of toner backed up behind the doctor blade 36 due to the rotational action of the developer roller 31. Should toner continue to be supplied so as to fill the developer roller chamber 35, the excess pressure created thereby tends to force excess toner under the doctor blade 36 to be carried by the developer roller 31 to the photoconductor drum 19. This in turn creates undesirable prints and further consumes excessive toner. Additionally, the excessive toner pressure tends to force large toner particles into the interface of the doctor blade 36 and the developer roller 31 thus preventing a free flow of toner at these areas causing streaking (i.e., lack of toner) on the print. Thus, the toner metering roller 41 and its associated flaps 45, 46 and 47 serve to provide a continuous fresh supply of toner 44 to the developer roller chamber 35 while maintaining an equilibrium level 65 within the developer roller chamber 35.

The action of the toner metering roller 41 and the flaps 45–47 is depicted in the sequential motion diagram of FIG. 6. With reference thereto, it will be assumed that a small amount of toner is located on the uppermost flat of the toner metering roller 41 in FIG. 6*a*. FIGS. 6*b*–6*f* illustrate the continued rotation of the toner metering roller 41 so that toner falls from the uppermost flat into the developer roller chamber 35 of FIG. 4. Meanwhile, the flaps 45 and 47 prevent further toner from escaping the supply chamber 39. FIGS. 6*g*–6*p* display the scraping action of the flexible fingers 49 against the toner carrying surface to insure that toner is dislodged therefrom. FIGS. 6*g*–6*p* also show how the flat surfaces of the toner metering roller 41 may be loaded with toner which falls between the flaps 45 and 47 as the toner metering roller rotates. The action of these flaps insures that a small metered amount of toner is provided to the developer roller chamber 35 of FIG. 4 upon each one half rotation of the toner metering roller 41.

Figure 6A:
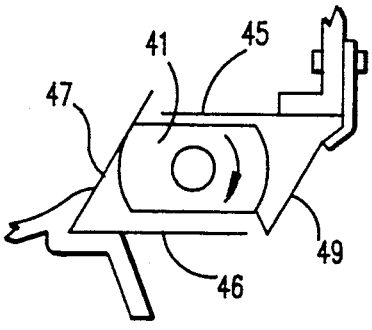
FIG. 6 is a sequential motion diagram illustrating the toner metering action of the developer apparatus.

As has been described with respect to FIG. 4, when the amount of toner supplied to the developer roller chamber 35 reaches an equilibrium level 65, it is necessary to maintain this equilibrium level without appreciably adding further amounts of toner to the developer roller chamber 35. In order to accomplish this, the toner metering roller 41 acts to remove toner 34 from the developer roller chamber 35 after the toner 34 reaches the equilibrium level 65. At this equilibrium level, the toner is in contact with the toner metering roller 41 as it rotates. As can be seen in FIG. 6*a*, the gap between flap 46 and the flat surface of the toner metering roller 41 is greater than that between the flap 45 and the other flat surface of the toner metering roller 41. Should excessive toner pile up in the developer roller chamber 35 in the vicinity of the toner metering roller 41, it has the capability of removing more toner through the action of the lowermost flat surface of roller 41 and the flap 46 than is received through the action of the uppermost flat surface of roller 41 and the flap 45.

Figure 6B:
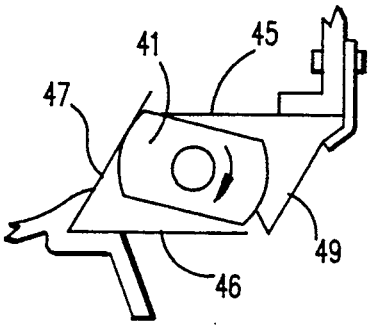
Figure 6C:
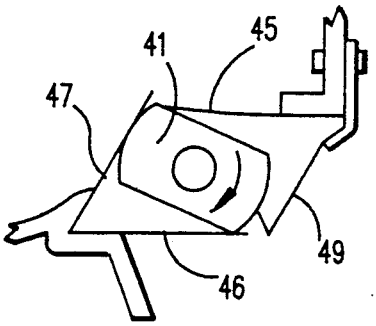
Figure 6D:
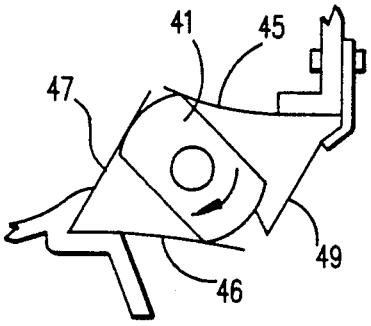
Figure 6E:
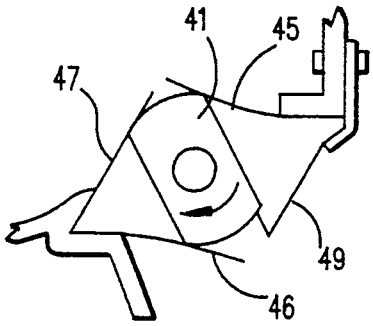
Figure 6F:
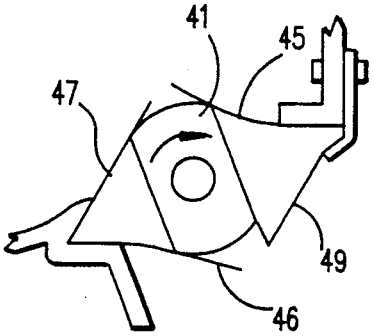
Figure 6G:
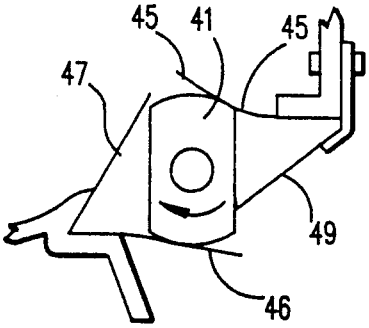
Figure 6H:
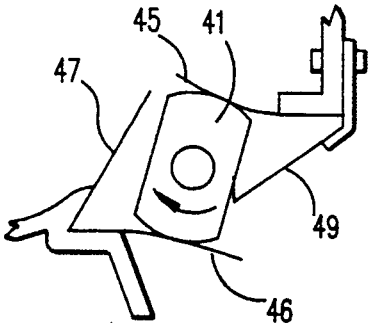
Figure 6K:
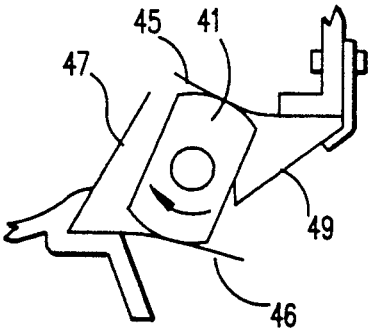
Figure 6M:
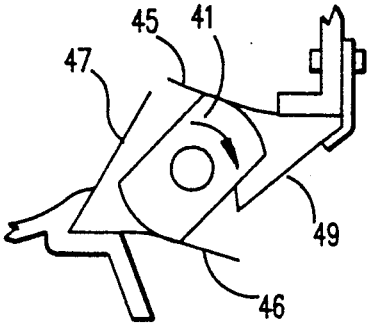
Figure 6N:
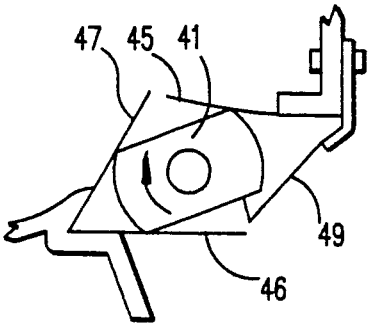
Figure 6P:
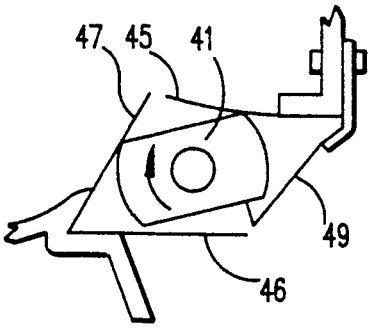

With reference to FIG. 6*a*, the lowermost flat surface of the toner metering roller 41 acts to scoop toner as it rotates. The toner thusly scooped is trapped between the flap 46 and the toner metering roller 41 with this continued rotation as depicted in FIG. 6*c*. Continued rotation removes the toner into the V-shaped area between the flaps 46 and 47 as depicted in FIG. 6*f*. As can be seen from FIGS. 6*g* through 6*m*, the flap 47 does not contact the flat surface as it rotates upward thereby allowing it to scoop the toner upward toward the supply chamber. As noted heretofore, the quantity of toner which could be removed to the upper chamber is greater than that which can be delivered to the lower chamber. This can be seen from the spacing of the flap 47 in FIGS. 6*g* through 6*n*. As the round section contacts flap 47 in FIG. 6*n*, toner remaining on the flat surface continues to be pushed upward into the chamber upon continued rotation (i.e., between the gap of flaps 47 and 45) and is unable to fall back towards the developer roller chamber. Flap 45 tends to limit the amount of toner which can be redelivered to the developer roller chamber upon subsequent rotation as seen in FIGS. 6*b* and 6*a*.

Referring once again to FIG. 4 of the drawing, it has been described how toner is delivered from a supply chamber 39 to the developer roller chamber 35 through the action of the toner metering roller 41 and its associated flaps 45, 46 and 47. When the cartridge is initially placed into use, the level of toner 34 is below the equilibrium level 65.

Since the photoconductor drum 19, developer roller 31, toner adder roller 37 and toner metering roller 41 are connected together to a common drive source, their turn ratio is set so that the toner supplied through action of the toner metering roller to the developer roller chamber 35 is greater than that consumed due to the rotational action of the developer roller 31. Thus, over time, the toner 34 in the developer roller chamber 35 builds up to its equilibrium level 65 whereupon further toner build up is prevented by the pumping action of the toner metering roller 41.

It can now be readily understood that fresh toner 44 is continuously supplied to the developer roller chamber 35 whenever the developer roller 31 rotates thereby insuring a proper mixture of small toner particles to large toner particles within the toner 34. Further, by maintaining the equilibrium level 65, excessive toner 34 build up behind the doctor blade 36 is prevented thereby insuring the provision of a uniform amount of toner on the developer roller 31 once it has passed the doctor blade 36. Further, uniform toner height along the length of the developer roller 31 is maintained even when printing black areas in one zone of the image. This in turn provides good print images.

While the invention has been disclosed with respect to a developer roller 31 which contacts a photoconductor 19, it would work equally well with a developer roller which is separated from the photoconductor drum 19 by a small gap. In such systems, the toner is made of materials exhibiting magnetic properties and a magnetic field is created to cause the movement of the toner to the photoconductor.

Additionally, the toner metering roller 41 has been described with two flat surfaces utilized to effect the pumping action. A roller with a single flat surface or with many flat surfaces could be utilized depending upon the rotational speed of the roller and its geometry with respect to its associated flaps. Further, any flattened surface such as a slightly rounded surface would function to move the toner.

While the invention has been particularly shown and described with reference to a preferred embodiment thereof, it should be understood by those skilled in the art that the foregoing and other changes in form and detail may be made therein without departing from the spirit and scope of the invention.

What is claimed is:

1. A developer apparatus for supplying toner to an electrostatically charged imaging surface comprising:

a supply chamber for containing a supply of toner;

a developer chamber;

developer means for removing toner from the developer chamber to the electrostatically charged surface, the developer means including a rotatable developer roller and a doctor blade for metering the amount of toner removed from the developer chamber to the charged imaging surface;

metering means for supplying toner from the supply chamber to the developer chamber and for removing toner from the developer chamber back to the supply chamber when the level of the toner in the developer chamber exceeds an equilibrium level.

2. A developer apparatus for supplying toner to an electrostatically charged imaging surface comprising:

a supply chamber for containing a supply of toner;

a developer chamber;

developer means for removing toner from the developer chamber to the electrostatically charged surface;

metering means for supplying toner from the supply chamber to the developer chamber and for removing toner from the developer chamber back to the supply chamber when the level of the toner in the developer chamber exceeds an equilibrium level, the metering means including a flattened roller cooperating with flexible flaps, said flaps allowing the metering means to remove more toner to the supply chamber than simultaneously supplied to the developer chamber.

3. The developer apparatus set forth in claim 1 wherein the metering means includes a flattened roller cooperating with flexible flaps, said flaps allowing the metering means to remove more toner to the supply chamber than simultaneously supplied to the developer chamber.

4. The developer apparatus set forth in claim 3 wherein the rotatable developer roller and the flattened roller are each directly connected to a common drive means for simultaneous rotation.

5. The developer apparatus set forth in claim 2 further including a passageway connecting said developer chamber to said supply chamber to provide even pressure distribution between the chambers during operation of the toner metering means.

6. The developer apparatus set forth in claim 5 wherein said passageway has a restriction which retards the flow of toner therethrough.

7. The developer apparatus set forth in claim 2 further including a movable paddle means located within the supply chamber for moving toner to the vicinity of the metering means.

8. A developer apparatus for supplying toner to an electrostatically charged imaging surface comprising:

a supply chamber for containing a supply of toner;

a developer chamber;

developer means for removing toner from the developer chamber to the electrostatically charged surface;

a roller having at least one flattened surface located between the supply chamber and the developer chamber for supplying toner from the supply chamber to the developer chamber and for removing toner from the developer chamber back to the supply chamber; and a first flexible flap separating the roller from the supply chamber and being spaced a first distance from the roller and a second flexible flap separating the roller from the developer chamber and being spaced a second distance from the roller, the second distance being greater than the first distance so that the flattened surface moves more toner from between the second flap and the flattened surface than from between the first flap and the flattened surface when the level of the toner in the developer chamber exceeds an equilibrium level.

9. The developer apparatus set forth in claim 8 wherein the developer means includes a rotatable developer roller and a doctor blade for metering the amount of toner removed from the developer chamber to the charged imaging surface.

10. A developer apparatus for supplying toner to an electrostatically charged imaging surface comprising:

a supply chamber for containing a supply of toner;

a developer chamber;

developer means for removing toner from the developer chamber to the electrostatically charged surface;

metering means for supplying toner from the supply chamber to the developer chamber and for removing toner from the developer chamber back to the supply chamber when the height of the toner in the developer chamber exceeds an equilibrium level.

11. The developer apparatus set forth in claim 10 wherein the developer means includes a rotatable developer roller and a doctor blade for metering the amount of toner removed from the developer chamber to the charged imaging surface.

12. The developer apparatus set forth in claim 10 wherein the metering means includes a flattened roller cooperating with flexible flaps, said flaps allowing the metering means to remove more toner to the supply chamber than simultaneously supplied to the developer chamber.

* * * * *